US010861367B2

(12) United States Patent
Zheng et al.

(10) Patent No.: US 10,861,367 B2
(45) Date of Patent: Dec. 8, 2020

(54) DRIVE METHOD FOR DISPLAY PANEL

(71) Applicant: WUHAN CHINA STAR OPTOELECTRONICS TECHNOLOGY CO., LTD., Wuhan (CN)

(72) Inventors: Lihua Zheng, Wuhan (CN); Mang Zhao, Wuhan (CN); Yong Tian, Wuhan (CN)

( * ) Notice: Subject to any disclaimer, the term of this patent is extended or adjusted under 35 U.S.C. 154(b) by 161 days.

(21) Appl. No.: 16/335,249

(22) PCT Filed: Dec. 19, 2018

(86) PCT No.: PCT/CN2018/122198
§ 371 (c)(1),
(2) Date: Mar. 21, 2019

(87) PCT Pub. No.: WO2020/107577
PCT Pub. Date: Jun. 4, 2020

(65) Prior Publication Data

US 2020/0251034 A1 Aug. 6, 2020

(30) Foreign Application Priority Data

Nov. 28, 2018 (CN) ..... 2018 1 1448996

(51) Int. Cl.
*G09G 5/10* (2006.01)
*G09G 3/20* (2006.01)

(52) U.S. Cl.
CPC ..... *G09G 3/20* (2013.01); *G09G 2300/0804* (2013.01); *G09G 2310/0202* (2013.01); *G09G 2310/0297* (2013.01); *G09G 2330/023* (2013.01)

(58) Field of Classification Search
CPC ..... G09G 3/20; G09G 2300/0804; G09G 2310/0202; G09G 2310/0297; G09G 2330/023; G09G 2330/021; G09G 2300/0465; G09G 3/3611; G09G 2310/0213; G09G 3/36; G09G 2310/06
See application file for complete search history.

(56) References Cited

U.S. PATENT DOCUMENTS

2019/0355311 A1* 11/2019 Ota ..... G09G 3/3266

* cited by examiner

*Primary Examiner* — Adam R. Giesy

(57) ABSTRACT

According to a drive method for the display panel, m multiplex signals sequentially generate the high level pulse at the beginning of the (2i−1)th row period in a predetermined order. The high level pulse of the multiplex signal that is the last one to generate the high level pulse in the (2i−1)th row period continues until the end of the (2i−1)th row period. The m multiplex signals sequentially generate the high level pulse at the beginning of the (2i)th row period in a reverse order to the predetermined order. The high level pulse of the multiplex signal that is the last one to generate the high level pulse in the (2i)th row period continues until the end of the 2i row period. As a result, the number of times that the levels of the multiplex signals are changed in a frame period can be decreased to reduce the power consumption.

10 Claims, 10 Drawing Sheets

DRIVE METHOD FOR DISPLAY PANEL

BACKGROUND

1. Field of the Invention

The present disclosure relates to the field of display technology, more particularly, to a drive method for a display panel.

2. Description of the Related Art

With the development of display technology, flat display devices, such as liquid crystal display (LCD), have gradually replaced cathode ray tube (CRT) displays due to their advantages of high image quality, power saving, slim body and wide application range. They are extensively used in various consumer electronic products, including mobile phones, televisions, personal digital assistants, digital cameras, notebook computers, desktop computers, and the like, and have become the mainstream in display devices.

Currently, most of the liquid crystal display devices on the market are backlit liquid crystal display devices, each of which includes a liquid crystal display panel and a backlight module. The working principle of the liquid crystal display panel is to fill liquid crystal molecules between a thin film transistor array substrate (TFT array substrate) and a color filter substrate (CF substrate), and apply a driving voltage to the two substrates so as to control the rotation direction of the liquid crystal molecules. The light from the backlight module is refracted to generate a picture.

In the driver architecture of a liquid crystal display device in the related art, one pixel electrode has a data line and a gate line. This method can well control the turning on of the gate on each scan line and the input of data on each data line. However, as the resolution of the liquid crystal display panel increases, the numbers of data lines and scan lines also increase, which leads to an increase of the area occupied by the fanout wires of the data lines. As a result, the transmittance and display effect are affected. To solve this problem, the multiplexed driver architecture has been widely used, for example, the 1 to 6 De-mux driver architecture. The so-called 1 to 6 De-mux driver architecture refers to the use of one data signal to charge pixels of six columns by using the principle of time division multiplexing. A description is provided with reference to FIG. 1. A display panel of a 1 to 6 De-mux driver architecture in the related art comprises a plurality of driving units, each of which comprises a plurality of sub-pixels 100 arranged in a plurality of rows and 12 columns, 12 data lines 200, a plurality of scan lines 300, and two multiplexing modules 400. One column of sub-pixels 100 are connected to one data line 200 correspondingly, and one row of sub-pixels 100 are connected to one scan line 300 correspondingly. Each of the multiplexing modules 400 comprises six thin film transistors T10. Gates of the six thin film transistors T10 in each of the multiplexing modules 400 are respectively connected to a first multiplex signal MUX10, a second multiplex signal MUX20, a third multiplex signal MUX30, a fourth multiplex signal MUX40, a fifth multiplex Signal MUX50 and a sixth multiplex signal MUX60.

Sources of the six thin film transistors T10 in one of the two multiplexing modules 400 are all connected to an Nth data signal DN, here N is a positive integer. Drains of the six thin film transistors T10 in the one of the two multiplexing modules 400 are respectively connected to the six data lines 200 connected to the sub-pixels 100 of odd columns in the 12 columns of sub-pixels 100. Sources of the six thin film transistors T10 of another one of the two multiplexing modules 400 are all connected to an N+1th data signal DN+1. Output terminals of the six thin film transistors T10 of the another one of the two multiplexing modules 400 are respectively connected to the six data lines 200 connected to the sub-pixels 100 of even columns in the 12 columns of sub-pixels 100. A description is provided with reference to FIG. 2. When the display panel is driven, a plurality of frame periods are sequentially performed. Each of the frame periods comprises a plurality of row periods that are sequentially performed, and the plurality of scan lines 300 are sequentially at a high level in the plurality of row periods. In each of the row periods, the first multiplex signal MUX10, the second multiplex signal MUX20, the third multiplex signal MUX30, the fourth multiplex signal MUX40, the fifth multiplex signal MUX50 and the sixth multiplex signal MUX60 sequentially generate a high level pulse to control the corresponding thin film transistor T10 to be turned on so as to write a corresponding data signal into the corresponding sub-pixel 100. This drive method can reduce the area occupied by the fanout wires of the data lines to achieve a narrow bezel, but each of the multiplex signals needs to be changed from a low level to a high level and then to the low level within one row period. The power consumption is relatively high.

SUMMARY

One objective of the present disclosure is to provide a drive method for a display panel that can reduce the number of times that the levels of the multiplex signals are changed to reduce the power consumption.

The present disclosure provides a drive method for a display panel. The drive method for the display panel comprises the following steps:

step S1: providing a display panel;

the display panel comprising a plurality of driving units, each of the driving units comprising a plurality of sub-pixels arranged in a plurality of rows and 2m columns, 2m data lines and two multiplexing modules, wherein m is a positive integer greater than one, one column of sub-pixels being connected to a data line correspondingly, each of the multiplexing modules comprising m switching elements, the m switching elements of each of the multiplexing modules being respectively connected to m multiplex signals, input terminals of the m switching elements of one of the two multiplexing modules being all connected to an nth data signal, output terminals of the m switching elements of the one of the two multiplexing modules being respectively connected to m data lines connected to the sub-pixels of odd columns in the 2m columns of sub-pixels, input terminals of the m switching elements of another one of the two multiplexing modules being all connected to an n+1th data signal, output terminals of the m switching elements of the another one of the two multiplexing modules being respectively connected to m data lines connected to the sub-pixels of even columns in the 2m columns of sub-pixels, wherein n is a positive integer;

step S2: entering a (2i−1)th row period;

the m multiplex signals sequentially generating a high level pulse at a beginning of the (2i−1)th row period in a predetermined order, the high level pulse of the multiplex signal that is a last one to generate the high level pulse in the (2i−1)th row period continuing until an end of the (2i−1)th row period, wherein i is a positive integer;

step S3: entering a (2i)th row period;

the m multiplex signals sequentially generating the high level pulse at a beginning of the (2i)th row period in a reverse order to the predetermined order, the high level pulse of the multiplex signal that is a last one to generate the high level pulse in the (2i)th row period continuing until an end of the 2i row period.

According to one embodiment of the present disclosure, m is 6. Control terminals of the six switching elements in each of the multiplexing modules are respectively connected to a first multiplex signal, a second multiplex signal, a third multiplex signal, a fourth multiplex signal, a fifth multiplex signal and a sixth multiplex signal.

According to another embodiment of the present disclosure, in step S2 the first multiplex signal, the second multiplex signal, the third multiplex signal, the fourth multiplex signal, the fifth multiplex signal, and the sixth multiplex signal sequentially generate the high level pulse in the (2i−1)th row period;

in step S3 the sixth multiplex signal, the fifth multiplex signal, the fourth multiplex signal, the third multiplex signal, the second multiplex signal, and the first multiplex signal sequentially generate the high level pulse in the (2i)th row period.

According to another embodiment of the present disclosure, in step S2 the fourth multiplex signal, the fifth multiplex signal, the sixth multiplex signal, the first multiplex signal, the second multiplex signal, and the third multiplex signal sequentially generate the high level pulse in the (2i−1)th row period;

in step S3 the third multiplex signal, the second multiplex signal, the first multiplex signal, the sixth multiplex signal, the fifth multiplex signal, and the fourth multiplex signal sequentially generate the high level pulse in the (2i)th row period. According to another embodiment of the present disclosure, in step S2 the third multiplex signal, the fourth multiplex signal, the fifth multiplex signal, the sixth multiplex signal, the first multiplex signal, and the second multiplex signal sequentially generate the high level pulse in the (2i−1)th row period;

in step S3 the second multiplex signal, the first multiplex signal, the sixth multiplex signal, the fifth multiplex signal, the fourth multiplex signal, and the third multiplex signal sequentially generate the high level pulse in the (2i)th row period.

According to another embodiment of the present disclosure, in step S2 the second multiplex signal, the third multiplex signal, the fourth multiplex signal, the fifth multiplex signal, the sixth multiplex signal, and the first multiplex signal sequentially generate the high level pulse in the (2i−1)th row period;

in step S3 the first multiplex signal, the sixth multiplex signal, the fifth multiplex signal, the fourth multiplex signal, the third multiplex signal, and the second multiplex signal sequentially generate the high level pulse in the (2i)th row period.

According to another embodiment of the present disclosure, in step S2 the fifth multiplex signal, the sixth multiplex signal, the first multiplex signal, the second multiplex signal, the third multiplex signal, and the fourth multiplex signal sequentially generate the high level pulse in the (2i−1)th row period;

in step S3 the fourth multiplex signal, the third multiplex signal, the second multiplex signal, the first multiplex signal, the sixth multiplex signal, and the fifth multiplex signal, sequentially generate the high level pulse in the (2i)th row period.

According to another embodiment of the present disclosure, in step S2 the sixth multiplex signal, the first multiplex signal, the second multiplex signal, the third multiplex signal, the fourth multiplex signal, and the fifth multiplex signal sequentially generate the high level pulse in the (2i−1)th row period;

in step S3 the fifth multiplex signal, the fourth multiplex signal, the third multiplex signal, the second multiplex signal, the first multiplex signal, and the sixth multiplex signal sequentially generate the high level pulse in the (2i)th row period.

According to another embodiment of the present disclosure, the switching element is a thin film transistor, a control terminal of the switching element is a gate of the thin film transistor, an input terminal of the switching element is a source of the thin film transistor, and an output terminal of the switching element is a drain of the thin film transistor.

According to another embodiment of the present disclosure, the driving unit further comprises a plurality of scan lines, one row of sub-pixels are connected to one scan line correspondingly;

in step S2, a voltage on the scan line corresponding to a pth row of sub-pixels is at a high level, and voltages on the scan lines other than the scan line corresponding to the pth row of sub-pixels are at a low level in the (2i−1)th row period, wherein P is a positive integer;

in step S3, a voltage on the scan line corresponding to a p+1th row of sub-pixels is at the high level, and voltages on the scan lines other than the scan line corresponding to the p+1th row of sub-pixels are at the low level in the (2i)th row period.

The beneficial effects of the present disclosure are as follows. According to the drive method for the display panel of the present disclosure, the m multiplex signals sequentially generate the high level pulse at the beginning of the (2i−1)th row period in a predetermined order. The high level pulse of the multiplex signal that is the last one to generate the high level pulse in the (2i−1)th row period continues until the end of the (2i−1)th row period. The m multiplex signals sequentially generate the high level pulse at the beginning of the (2i)th row period in a reverse order to the predetermined order. The high level pulse of the multiplex signal that is the last one to generate the high level pulse in the (2i)th row period continues until the end of the 2i row period. As a result, the number of times that the levels of the multiplex signals are changed in a frame period can be decreased to reduce the power consumption.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

For the purpose of description rather than limitation, the following provides such specific details as a specific system structure, interface, and technology for a thorough understanding of the application. However, it is understandable by persons skilled in the art that the application can also be implemented in other embodiments not providing such specific details.

Figure 1:
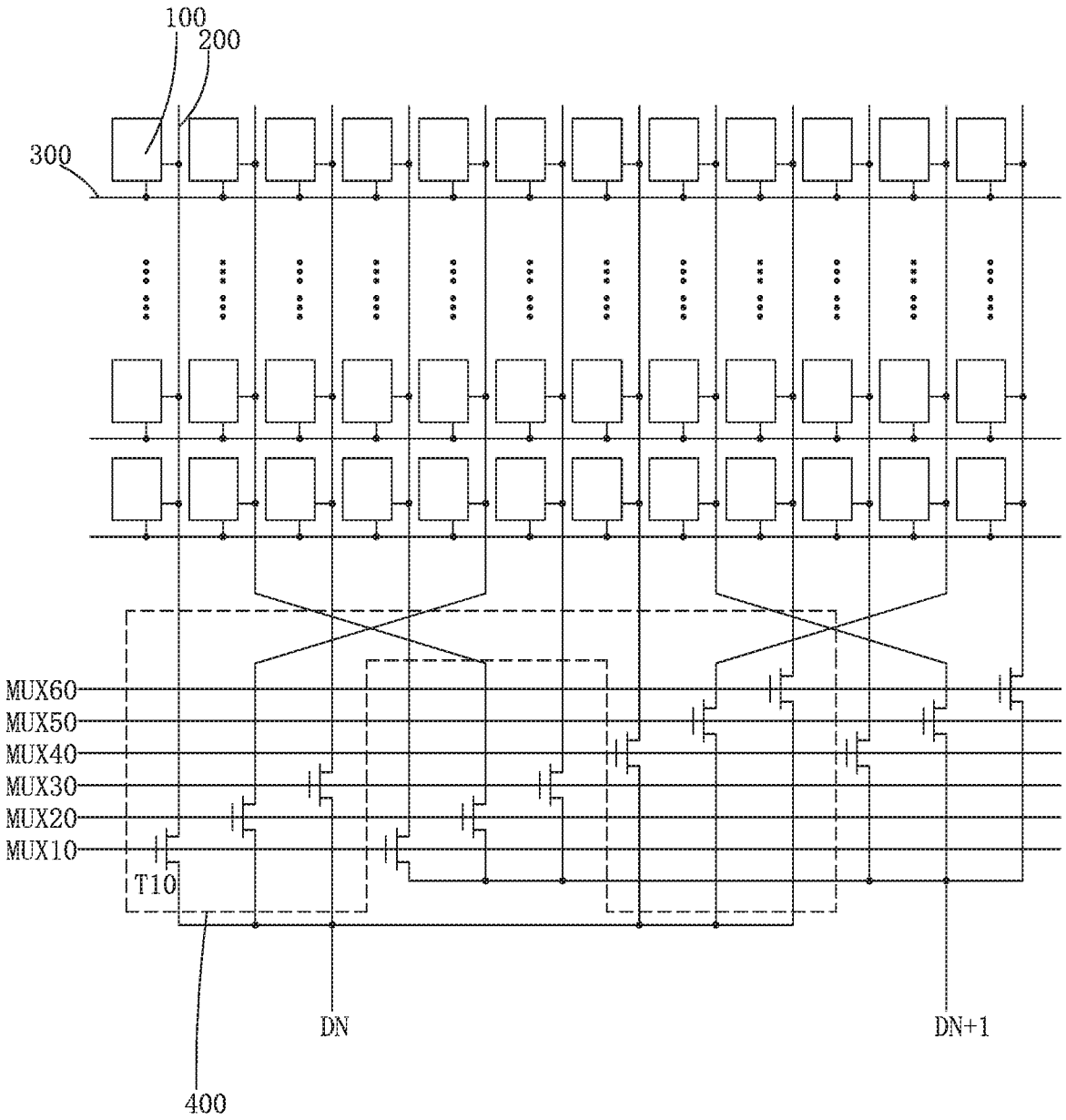
Fig. 1 (Related art)
FIG. 1 is a structural diagram of a display panel of a 1 to 6 De-mux driver architecture in the related art.
Figure 2:
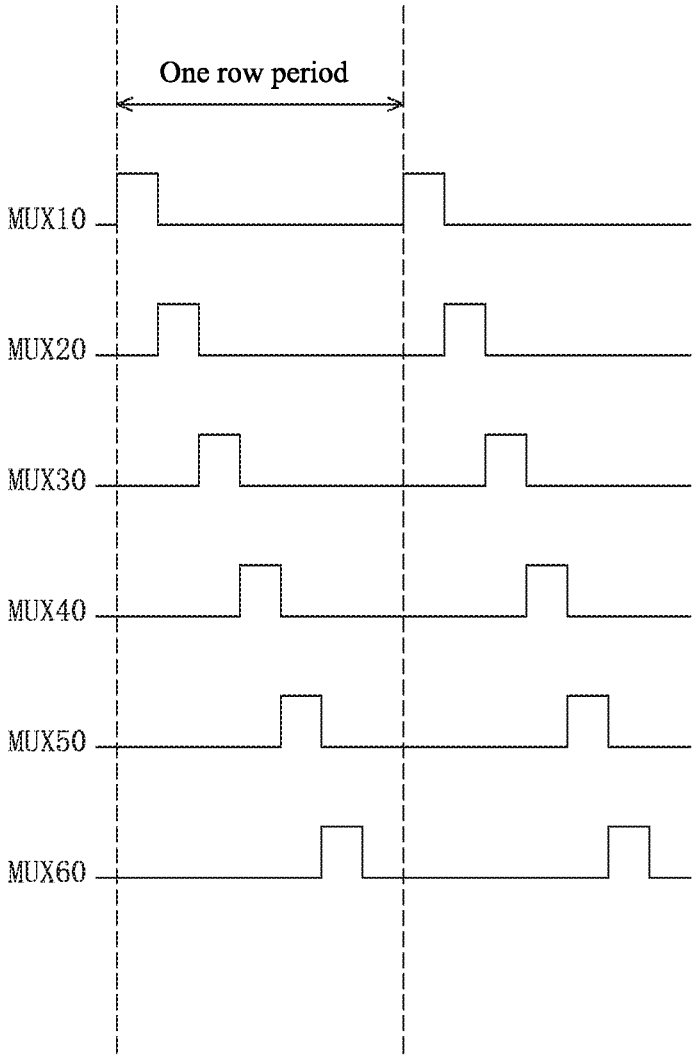
Fig. 2 (Related art)
FIG. 2 is a drive timing diagram of the display panel shown in FIG. 1.
Figure 3:
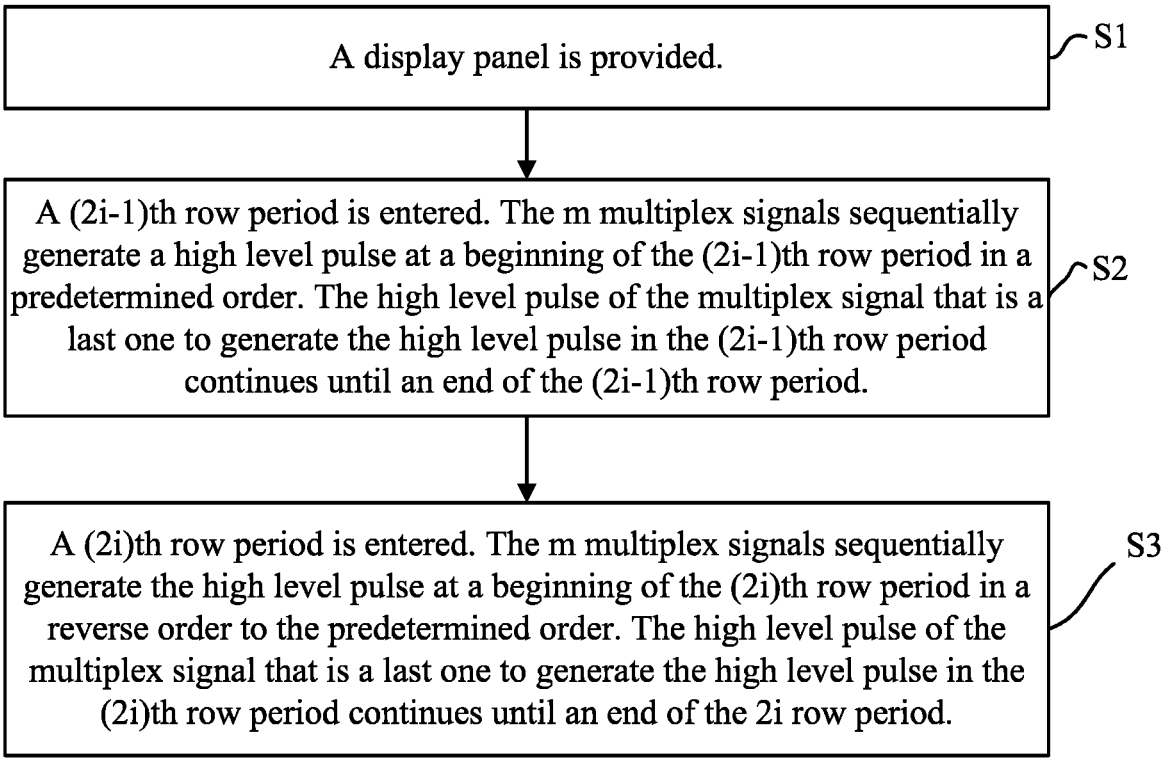
FIG. 3 is a flowchart of a drive method of a display panel according to the present disclosure.
Figure 4:
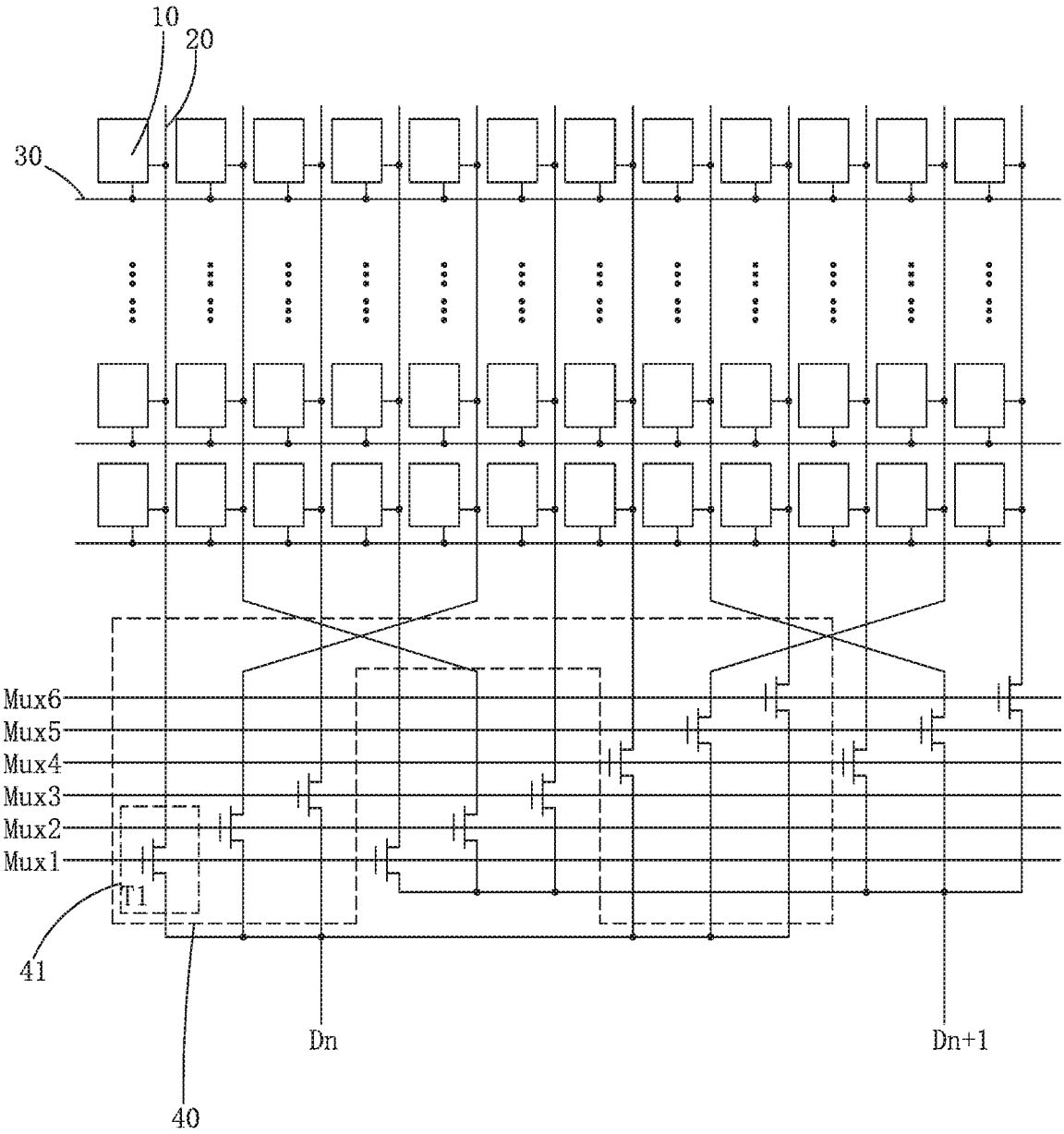
FIG. 4 is a schematic diagram of step S1 of a drive method of a display panel according to the present disclosure.

A description is provided with reference to FIG. 3. The present disclosure provides a drive method for a display panel that comprises the following steps:

Step S1: a display panel is provided with reference to FIG. 4.

The display panel comprises a plurality of driving units. Each of the driving units comprises a plurality of sub-pixels 10 arranged in a plurality of rows and 2m columns, 2m data lines 20 and two multiplexing modules 40, here m is a positive integer greater than 1. One column of sub-pixels 10 are connected to a data line 20 correspondingly. Each of the multiplexing modules 40 comprises m switching elements 41. The m switching elements 41 of each of the multiplexing modules 40 are respectively connected to m multiplex signals. Input terminals of the m switching elements 41 of one of the two multiplexing modules 40 are all connected to an nth data signal Dn, output terminals of the m switching elements 41 of the one of the two multiplexing modules 40 are respectively connected to m data lines 20 connected to the sub-pixels 10 of odd columns in the 2m columns of sub-pixels 10. Input terminals of the m switching elements 41 of another one of the two multiplexing modules 40 are all connected to an n+1th data signal Dn+1, output terminals of the m switching elements 41 of the another one of the two multiplexing modules 40 are respectively connected to m data lines 20 connected to the sub-pixels 10 of even columns in the 2m columns of sub-pixels 10. n is a positive integer.

The switching element 41 is a thin film transistor T1. A control terminal of the switching element 41 is a gate of the thin film transistor T1, an input terminal of the switching element 41 is a source of the thin film transistor T1, and an output terminal of the switching element 41 is a drain of the thin film transistor T1.

The driving unit further comprises a plurality of scan lines 30. One row of sub-pixels 10 are connected to one scan line 30 correspondingly.

A description is provided with reference to FIG. 4. In a first embodiment of the present disclosure, m is 6. The control terminals of the six switching elements 41 in each of the multiplexing modules 40 are respectively connected to a first multiplex signal MUX1, a second multiplex signal MUX2, a third multiplex signal MUX3, a fourth multiplex signal MUX4, a fifth multiplex signal MUX5 and a sixth multiplex signal MUX6.

Step S2: A (2i−1)th row period is entered.

The m multiplex signals sequentially generate a high level pulse at a beginning of the (2i−1)th row period in a predetermined order. The high level pulse of the multiplex signal that is a last one to generate the high level pulse in the (2i−1)th row period continues until an end of the (2i−1)th row period, here i is a positive integer.

Figure 5:
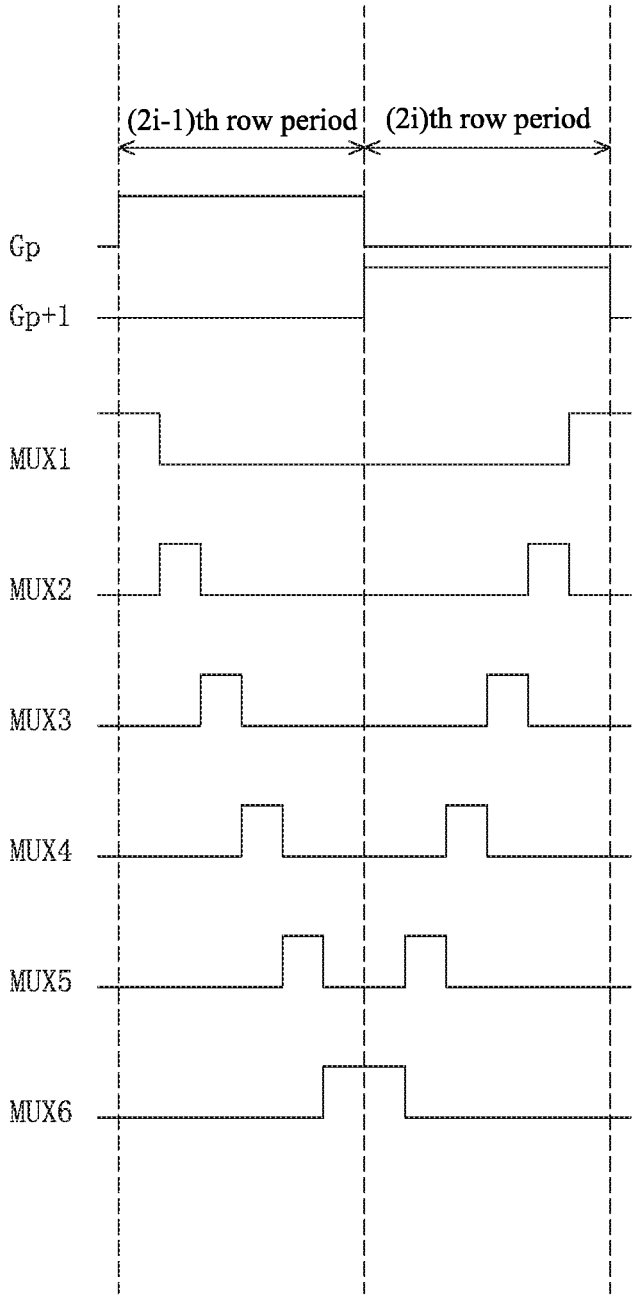
FIG. 5 is a schematic diagram of step S2 and step S3 of a drive method of a display panel according to a first embodiment of the present disclosure.

A description is provided with reference to FIG. 5. In step S2, the first multiplex signal MUX1, the second multiplex signal MUX2, the third multiplex signal MUX3, the fourth multiplex signal MUX4, the fifth multiplex signal MUX5, and the sixth multiplex signal MUX6 sequentially generate the high level pulse in the (2i−1)th row period according to the first embodiment of the present disclosure.

In step S2, a voltage Gp on the scan line 30 corresponding to a pth row of sub-pixels 10 is at a high level, and voltages on the scan lines 30 other than the scan line 30 corresponding to the pth row of sub-pixels 10 are at a low level in the (2i−1)th row period. P is a positive integer.

Step S3: A (2i)th row period is entered.

The m multiplex signals sequentially generate the high level pulse at a beginning of the (2i)th row period in a reverse order to the predetermined order. The high level pulse of the multiplex signal that is a last one to generate the high level pulse in the (2i)th row period continues until an end of the 2i row period.

A description is provided with reference to FIG. 5. In step S3, the sixth multiplex signal MUX6, the fifth multiplex signal MUX5, the fourth multiplex signal MUX4, the third multiplex signal MUX3, the second multiplex signal MUX2, and the first multiplex signal MUX1 sequentially generate the high level pulse in the (2i)th row period according to the first embodiment of the present disclosure.

In step S3, a voltage Gp+1 on the scan line 30 corresponding to a p+1th row of sub-pixels 10 is at the high level, and voltages on the scan lines 30 other than the scan line 30 corresponding to the p+1th row of sub-pixels 10 are at the low level in the (2i)th row period.

It is noted that the first multiplex signal MUX1, the second multiplex signal MUX2, the third multiplex signal MUX3, the fourth multiplex signal MUX4, the fifth multiplex signal MUX5, and the sixth multiplex signal MUX6 sequentially generate the high level pulse at the beginning of the (2i−1)th row period according to the first embodiment of the present disclosure. The high level pulse of the sixth multiplex signal MUX6 continues until the end of the (2i−1)th row period. The sixth multiplex signal MUX6, the fifth multiplex signal MUX5, the fourth multiplex signal MUX4, the third multiplex signal MUX3, the second multiplex signal MUX2, and the first multiplex signal MUX1 sequentially generate the high level pulse at the beginning of the (2i)th row period. The high level pulse of the first multiplex signal MUX1 continues until the end of the (2i)th row period. Therefore, the first multiplex signal MUX1 only needs to be changed from the high level to the low level and then to the high level within a duration of the (2i−1)th row period and the (2i)th row period, and the sixth multiplex signal MUX6 only needs to be changed from the low level to the high level and then to the low level within the duration of the (2i−1)th row period and the (2i)th row period. As a result, in a frame period, a total number of times that the six multiplex signals are changed from the low level to the high level and then to the low level is five times a number of rows of the sub-pixels 10. As compared with the related art, the total number of times that the six multiplex signals are changed from the low level to the high level and then to the low level is reduced by about one-sixth so as to effectively reduce the power consumption.

Figure 6:
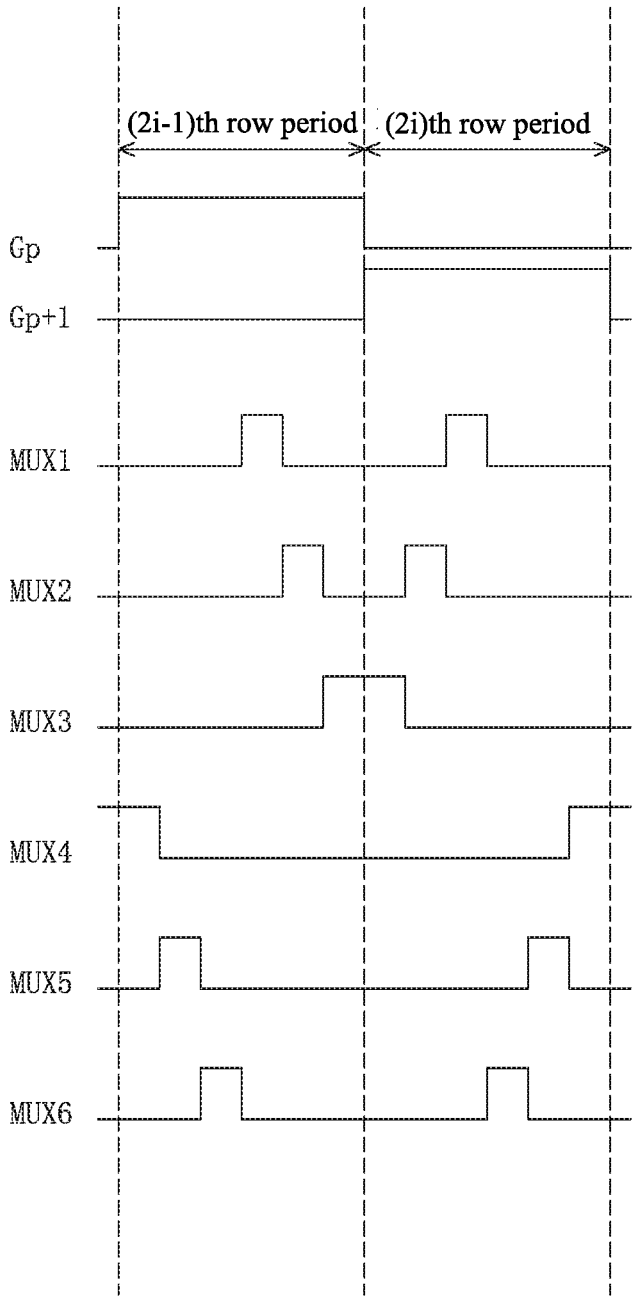
FIG. 6 is a schematic diagram of step S2 and step S3 of a drive method of a display panel according to a second embodiment of the present disclosure.

A description is provided with reference to FIG. 4 and FIG. 6. A drive method of a display panel according to a second embodiment of the present disclosure differs from the first embodiment as follows. In step S2, the fourth multiplex signal MUX4, the fifth multiplex signal MUX5, the sixth multiplex signal MUX6, the first multiplex signal MUX1, the second multiplex signal MUX2, and the third multiplex signal MUX3 sequentially generate the high level pulse in the (2i−1)th row period. In step S3, the third multiplex signal MUX3, the second multiplex signal MUX2, the first multiplex signal MUX1, the sixth multiplex signal MUX6, the fifth multiplex signal MUX5, and the fourth multiplex signal MUX4 sequentially generate the high level pulse in the (2i)th row period. Since the rest are the same as the first embodiment, a description in this regard is not provided.

It is noted that the fourth multiplex signal MUX4, the fifth multiplex signal MUX5, the sixth multiplex signal MUX6, the first multiplex signal MUX1, the second multiplex signal MUX2, and the third multiplex signal MUX3 sequentially generate the high level pulse at the beginning of the (2i−1)th row period according to the second embodiment of the present disclosure. The high level pulse of the third multiplex signal MUX3 continues until the end of the (2i−1)th row period. The third multiplex signal MUX3, the second multiplex signal MUX2, and the first multiplex signal MUX1, the sixth multiplex signal MUX6, the fifth multiplex signal MUX5, the fourth multiplex signal MUX4 sequentially generate the high level pulse at the beginning of the (2i)th row period. The high level pulse of the fourth multiplex signal MUX4 continues until the end of the (2i)th row period. Therefore, the third multiplex signal MUX3 only needs to be changed from the high level to the low level and then to the high level within a duration of the (2i−1)th row period and the (2i)th row period, and the fourth multiplex signal MUX4 only needs to be changed from the low level to the high level and then to the low level within the duration of the (2i−1)th row period and the (2i)th row period. As a result, in a frame period, a total number of times that the six multiplex signals are changed from the low level to the high level and then to the low level is five times a number of rows of the sub-pixels 10. As compared with the related art, the total number of times that the six multiplex signals are changed from the low level to the high level and then to the low level is reduced by about one-sixth so as to effectively reduce the power consumption.

Figure 7:
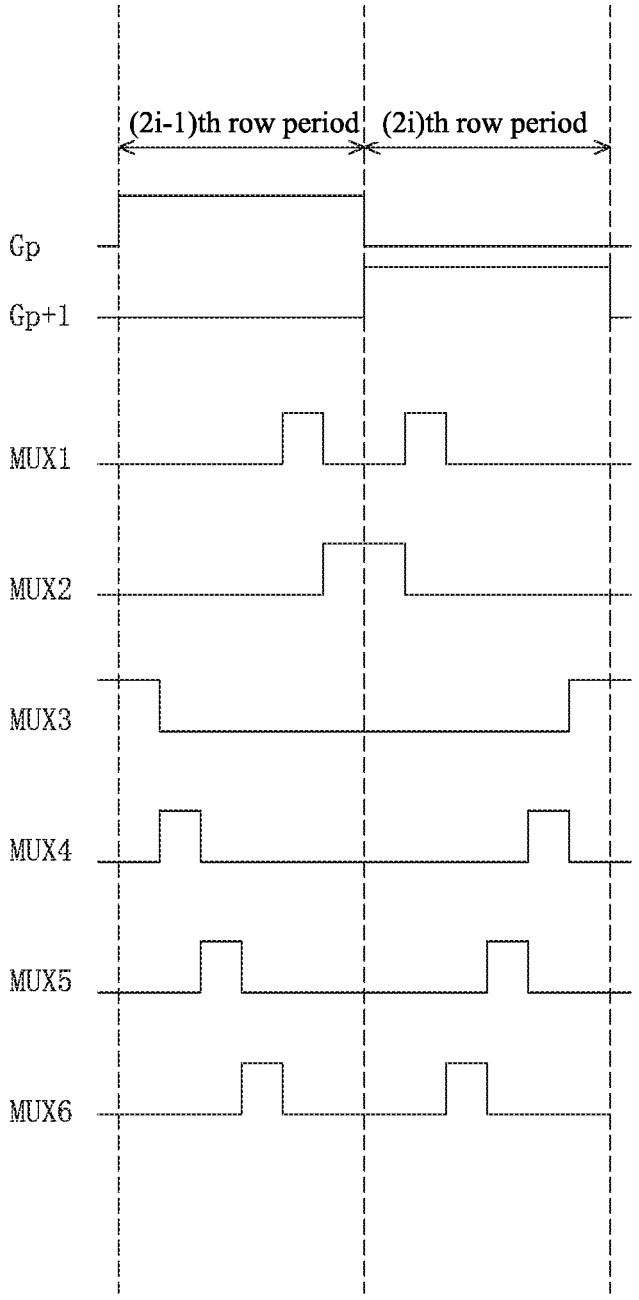
FIG. 7 is a schematic diagram of step S2 and step S3 of a drive method of a display panel according to a third embodiment of the present disclosure.

A description is provided with reference to FIG. 4 and FIG. 7. A drive method of a display panel according to a third embodiment of the present disclosure differs from the first embodiment as follows. In step S2, the third multiplex signal MUX3, the fourth multiplex signal MUX4, the fifth multiplex signal MUX5, the sixth multiplex signal MUX6, the first multiplex signal MUX1, and the second multiplex signal MUX2 sequentially generate the high level pulse in the (2i−1)th row period. In step S3, the second multiplex signal MUX2, the first multiplex signal MUX1, the sixth multiplex signal MUX6, the fifth multiplex signal MUX5, the fourth multiplex signal MUX4, and the third multiplex signal MUX3 sequentially generate the high level pulse in the (2i)th row period. Since the rest are the same as the first embodiment, a description in this regard is not provided.

It is noted that the third multiplex signal MUX3, the fourth multiplex signal MUX4, the fifth multiplex signal MUX5, the sixth multiplex signal MUX6, the first multiplex signal MUX1, and the second multiplex signal MUX2 sequentially generate the high level pulse at the beginning of the (2i−1)th row period according to the third embodiment of the present disclosure. The high level pulse of the second multiplex signal MUX2 continues until the end of the (2i−1)th row period. The second multiplex signal MUX2, the first multiplex signal MUX1, the sixth multiplex signal MUX6, the fifth multiplex signal MUX5, the fourth multiplex signal MUX4, and the third multiplex signal MUX3 sequentially generate the high level pulse at the beginning of the (2i)th row period. The high level pulse of the third multiplex signal MUX3 continues until the end of the (2i)th row period. Therefore, the second multiplex signal MUX2 only needs to be changed from the high level to the low level and then to the high level within a duration of the (2i−1)th row period and the (2i)th row period, and the third multiplex signal MUX3 only needs to be changed from the low level to the high level and then to the low level within the duration of the (2i−1)th row period and the (2i)th row period. As a result, in a frame period, a total number of times that the six multiplex signals are changed from the low level to the high level and then to the low level is five times a number of rows of the sub-pixels 10. As compared with the related art, the total number of times that the six multiplex signals are changed from the low level to the high level and then to the low level is reduced by about one-sixth so as to effectively reduce the power consumption.

Figure 8:
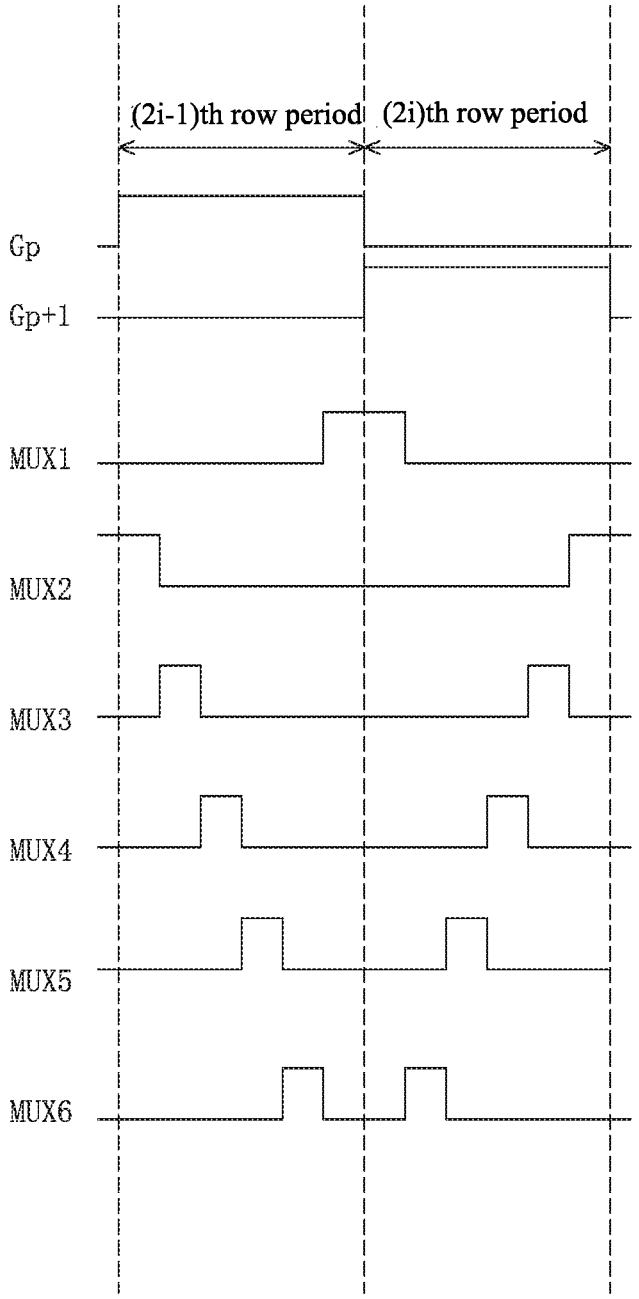
FIG. 8 is a schematic diagram of step S2 and step S3 of a drive method of a display panel according to a fourth embodiment of the present disclosure.

A description is provided with reference to FIG. 4 and FIG. 8. A drive method of a display panel according to a fourth embodiment of the present disclosure differs from the first embodiment as follows. In step S2, the second multiplex signal MUX2, the third multiplex signal MUX3, the fourth multiplex signal MUX4, the fifth multiplex signal MUX5, the sixth multiplex signal MUX6, the first multiplex signal MUX1 sequentially generate the high level pulse in the (2i−1)th row period. In step S3, the first multiplex signal MUX1, the sixth multiplex signal MUX6, the fifth multiplex signal MUX5, the fourth multiplex signal MUX4, the third multiplex signal MUX3, and the second multiplex signal MUX2 sequentially generate the high level pulse in the (2i)th row period. Since the rest are the same as the first embodiment, a description in this regard is not provided.

It is noted that the second multiplex signal MUX2, the third multiplex signal MUX3, the fourth multiplex signal MUX4, the fifth multiplex signal MUX5, the sixth multiplex signal MUX6, and the first multiplex signal MUX1 sequentially generate the high level pulse at the beginning of the (2i−1)th row period according to the fourth embodiment of the present disclosure. The high level pulse of the first multiplex signal MUX1 continues until the end of the (2i−1)th row period. The first multiplex signal MUX1, the sixth multiplex signal MUX6, the fifth multiplex signal MUX5, the fourth multiplex signal MUX4, the third multiplex signal MUX3, and the second multiplex signal MUX2 sequentially generate the high level pulse at the beginning of the (2i)th row period. The high level pulse of the second multiplex signal MUX2 continues until the end of the (2i)th row period. Therefore, the second multiplex signal MUX2 only needs to be changed from the high level to the low level and then to the high level within a duration of the (2i−1)th row period and the (2i)th row period, and the first multiplex signal MUX1 only needs to be changed from the low level to the high level and then to the low level within the duration of the (2i−1)th row period and the (2i)th row period. As a result, in a frame period, a total number of times that the six multiplex signals are changed from the low level to the high level and then to the low level is five times a number of rows of the sub-pixels 10. As compared with the related art, the total number of times that the six multiplex signals are changed from the low level to the high level and then to the low level is reduced by about one-sixth so as to effectively reduce the power consumption.

Figure 9:
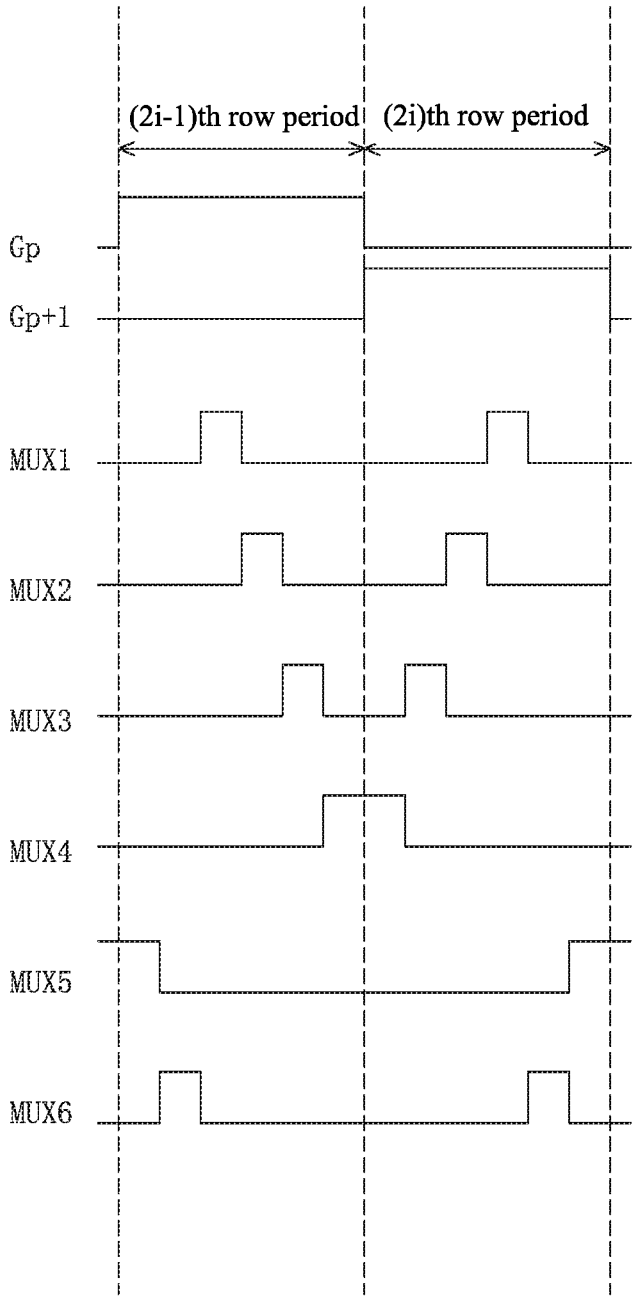
FIG. 9 is a schematic diagram of step S2 and step S3 of a drive method of a display panel according to a fifth embodiment of the present disclosure.

A description is provided with reference to FIG. 4 and FIG. 9. A drive method of a display panel according to a fifth embodiment of the present disclosure differs from the first embodiment as follows. In step S2, the fifth multiplex signal MUX5, the sixth multiplex signal MUX6, the first multiplex signal MUX1, the second multiplex signal MUX2, the third multiplex signal MUX3, and the fourth multiplex signal MUX4 sequentially generate the high level pulse in the (2i−1)th row period. In step S3, the fourth multiplex signal MUX4, the third multiplex signal MUX3, the second multiplex signal MUX2, the first multiplex signal MUX1, the sixth multiplex signal MUX6, and the fifth multiplex signal MUX5 sequentially generate the high level pulse in the (2i)th row period. Since the rest are the same as the first embodiment, a description in this regard is not provided.

It is noted that the fifth multiplex signal MUX5, the sixth multiplex signal MUX6, the first multiplex signal MUX1, the second multiplex signal MUX2, the third multiplex signal MUX3, and the fourth multiplex signal MUX4 sequentially generate the high level pulse at the beginning of the (2i−1)th row period according to the fifth embodiment of the present disclosure. The high level pulse of the first multiplex signal MUX1 continues until the end of the (2i−1)th row period. The fourth multiplex signal MUX4, the third multiplex signal MUX3, the second multiplex signal MUX2, the first multiplex signal MUX1, the sixth multiplex signal MUX6, and the fifth multiplex signal MUX5 sequentially generate the high level pulse at the beginning of the (2i)th row period. The high level pulse of the fifth multiplex signal MUX5 continues until the end of the (2i)th row period. Therefore, the fifth multiplex signal MUX5 only needs to be changed from the high level to the low level and then to the high level within a duration of the (2i−1)th row period and the (2i)th row period, and the fourth multiplex signal MUX4 only needs to be changed from the low level to the high level and then to the low level within the duration of the (2i−1)th row period and the (2i)th row period. As a result, in a frame period, a total number of times that the six multiplex signals are changed from the low level to the high level and then to the low level is five times a number of rows of the sub-pixels 10. As compared with the related art, the total number of times that the six multiplex signals are changed from the low level to the high level and then to the low level is reduced by about one-sixth so as to effectively reduce the power consumption.

Figure 10:
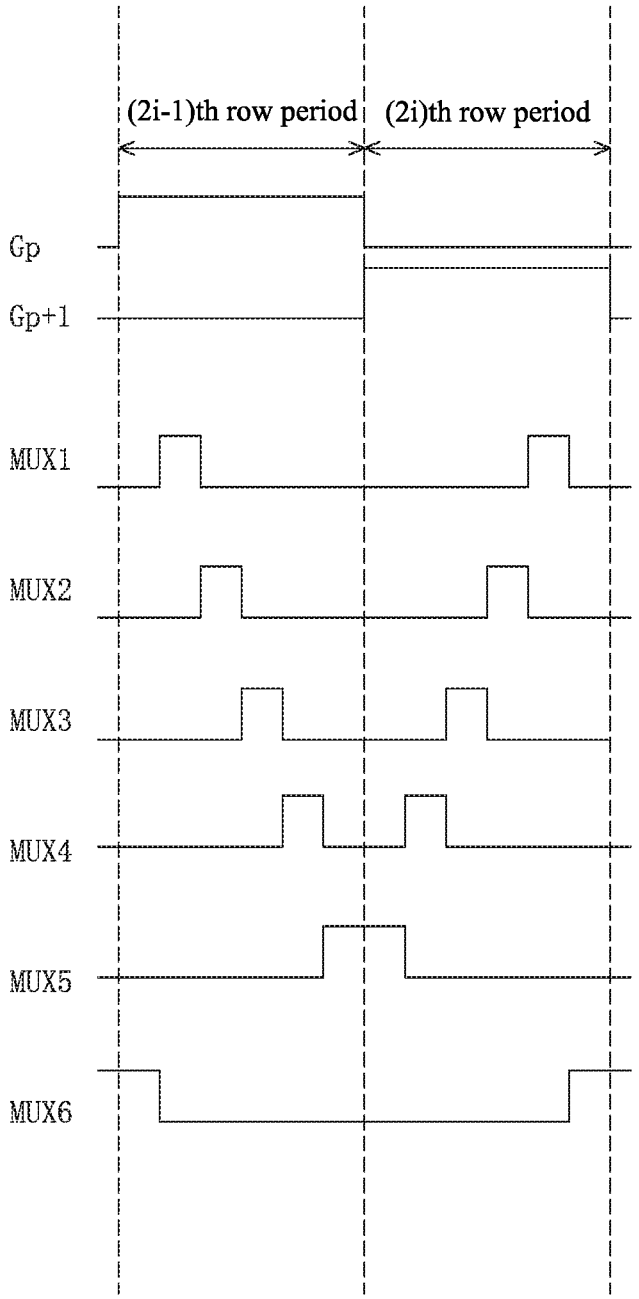
FIG. 10 is a schematic diagram of step S2 and step S3 of a drive method of a display panel according to a sixth embodiment of the present disclosure.

A description is provided with reference to FIG. 4 and FIG. 10. A drive method of a display panel according to a sixth embodiment of the present disclosure differs from the first embodiment as follows. In step S2, the sixth multiplex signal MUX6, the first multiplex signal MUX1, the second multiplex signal MUX2, the third multiplex signal MUX3, the fourth multiplex signal MUX4, and the fifth multiplex signal MUX5 sequentially generate the high level pulse in the (2i−1)th row period. In step S3, the fifth multiplex signal MUX5, the fourth multiplex signal MUX4, the third multiplex signal MUX3, the second multiplex signal MUX2, the first multiplex signal MUX1, and the sixth multiplex signal MUX6 sequentially generate the high level pulse in the (2i)th row period. Since the rest are the same as the first embodiment, a description in this regard is not provided.

It is noted that the sixth multiplex signal MUX6, the first multiplex signal MUX1, the second multiplex signal MUX2, the third multiplex signal MUX3, the fourth multiplex signal MUX4, and the fifth multiplex signal MUX5 sequentially generate the high level pulse at the beginning of the (2i−1)th row period according to the sixth embodiment of the present disclosure. The high level pulse of the first multiplex signal MUX1 continues until the end of the (2i−1)th row period. The fifth multiplex signal MUX5, the fourth multiplex signal MUX4, the third multiplex signal MUX3, the second multiplex signal MUX2, the first multiplex signal MUX1, and the sixth multiplex signal MUX6 sequentially generate the high level pulse at the beginning of the (2i)th row period. The high level pulse of the sixth multiplex signal MUX6 continues until the end of the (2i)th row period. Therefore, the fifth multiplex signal MUX5 only needs to be changed from the high level to the low level and then to the high level within a duration of the (2i−1)th row period and the (2i)th row period, and the sixth multiplex signal MUX6 only needs to be changed from the low level to the high level and then to the low level within the duration of the (2i−1)th row period and the (2i)th row period. As a result, in a frame period, a total number of times that the six multiplex signals are changed from the low level to the high level and then to the low level is five times a number of rows of the sub-pixels 10. As compared with the related art, the total number of times that the six multiplex signals are changed from the low level to the high level and then to the low level is reduced by about one-sixth so as to effectively reduce the power consumption.

In conclusion, according to the drive method for the display panel of the present disclosure, the m multiplex signals sequentially generate the high level pulse at the beginning of the (2i−1)th row period in a predetermined order. The high level pulse of the multiplex signal that is the last one to generate the high level pulse in the (2i−1)th row period continues until the end of the (2i−1)th row period. The m multiplex signals sequentially generate the high level pulse at the beginning of the (2i)th row period in a reverse order to the predetermined order. The high level pulse of the multiplex signal that is the last one to generate the high level pulse in the (2i)th row period continues until the end of the 2i row period. As a result, the number of times that the levels of the multiplex signals are changed in a frame period can be decreased to reduce the power consumption.

The present disclosure is described in detail in accordance with the above contents with the specific preferred examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

What is claimed is:

1. A drive method for a display panel comprising:

step S1: providing a display panel;

the display panel comprising a plurality of driving units, each of the driving units comprising a plurality of sub-pixels arranged in a plurality of rows and 2m columns, 2m data lines and two multiplexing modules, wherein m is a positive integer greater than one, one column of sub-pixels being connected to a data line correspondingly, each of the multiplexing modules comprising m switching elements, the m switching elements of each of the multiplexing modules being respectively connected to m multiplex signals, input terminals of the m switching elements of one of the two multiplexing modules being all connected to an nth data signal, output terminals of the m switching elements of the one of the two multiplexing modules being respectively connected to m data lines connected to the sub-pixels of odd columns in the 2m columns of sub-pixels, input terminals of the m switching elements of another one of the two multiplexing modules being all connected to an n+1th data signal, output terminals of the m switching elements of the another one of the two multiplexing modules being respectively connected to m data lines connected to the sub-pixels of even columns in the 2m columns of sub-pixels, wherein n is a positive integer;

step S2: entering a (2i−1)th row period;

the m multiplex signals sequentially generating a high level pulse at a beginning of the (2i−1)th row period in a predetermined order, the high level pulse of the multiplex signal that is a last one to generate the high level pulse in the (2i−1)th row period continuing until an end of the (2i−1)th row period, wherein i is a positive integer;

step S3: entering a (2i)th row period;

the m multiplex signals sequentially generating the high level pulse at a beginning of the (2i)th row period in a reverse order to the predetermined order, the high level pulse of the multiplex signal that is a last one to generate the high level pulse in the (2i)th row period continuing until an end of the 2i row period.

2. The drive method for the display panel as claimed in claim 1, wherein m is 6, control terminals of the six switching elements in each of the multiplexing modules are respectively connected to a first multiplex signal, a second multiplex signal, a third multiplex signal, a fourth multiplex signal, a fifth multiplex signal and a sixth multiplex signal.

3. The drive method for the display panel as claimed in claim 2, wherein in step S2 the first multiplex signal, the second multiplex signal, the third multiplex signal, the fourth multiplex signal, the fifth multiplex signal, and the sixth multiplex signal sequentially generate the high level pulse in the (2i−1)th row period;

in step S3 the sixth multiplex signal, the fifth multiplex signal, the fourth multiplex signal, the third multiplex signal, the second multiplex signal, and the first multiplex signal sequentially generate the high level pulse in the (2i)th row period.

4. The drive method for the display panel as claimed in claim 2, wherein in step S2 the fourth multiplex signal, the fifth multiplex signal, the sixth multiplex signal, the first multiplex signal, the second multiplex signal, and the third multiplex signal sequentially generate the high level pulse in the (2i−1)th row period;

in step S3 the third multiplex signal, the second multiplex signal, the first multiplex signal, the sixth multiplex signal, the fifth multiplex signal, and the fourth multiplex signal sequentially generate the high level pulse in the (2i)th row period.

5. The drive method for the display panel as claimed in claim 2, wherein in step S2 the third multiplex signal, the fourth multiplex signal, the fifth multiplex signal, the sixth multiplex signal, the first multiplex signal, and the second multiplex signal sequentially generate the high level pulse in the (2i−1)th row period;

in step S3 the second multiplex signal, the first multiplex signal, the sixth multiplex signal, the fifth multiplex signal, the fourth multiplex signal, and the third multiplex signal sequentially generate the high level pulse in the (2i)th row period.

6. The drive method for the display panel as claimed in claim 2, wherein in step S2 the second multiplex signal, the third multiplex signal, the fourth multiplex signal, the fifth multiplex signal, the sixth multiplex signal, and the first multiplex signal sequentially generate the high level pulse in the (2i−1)th row period;

in step S3 the first multiplex signal, the sixth multiplex signal, the fifth multiplex signal, the fourth multiplex signal, the third multiplex signal, and the second multiplex signal sequentially generate the high level pulse in the (2i)th row period.

7. The drive method for the display panel as claimed in claim 2, wherein in step S2 the fifth multiplex signal, the sixth multiplex signal, the first multiplex signal, the second multiplex signal, the third multiplex signal, and the fourth multiplex signal sequentially generate the high level pulse in the (2i−1)th row period;

in step S3 the fourth multiplex signal, the third multiplex signal, the second multiplex signal, the first multiplex signal, the sixth multiplex signal, and the fifth multiplex signal, sequentially generate the high level pulse in the (2i)th row period.

8. The drive method for the display panel as claimed in claim 2, wherein in step S2 the sixth multiplex signal, the first multiplex signal, the second multiplex signal, the third multiplex signal, the fourth multiplex signal, and the fifth multiplex signal sequentially generate the high level pulse in the (2i−1)th row period;

in step S3 the fifth multiplex signal, the fourth multiplex signal, the third multiplex signal, the second multiplex signal, the first multiplex signal, and the sixth multiplex signal sequentially generate the high level pulse in the (2i)th row period.

9. The drive method for the display panel as claimed in claim 1, wherein the switching element is a thin film transistor, a control terminal of the switching element is a gate of the thin film transistor, an input terminal of the switching element is a source of the thin film transistor, and an output terminal of the switching element is a drain of the thin film transistor.

10. The drive method for the display panel as claimed in claim 1, wherein the driving unit further comprises a plurality of scan lines, one row of sub-pixels are connected to one scan line correspondingly;

in step S2, a voltage on the scan line corresponding to a pth row of sub-pixels is at a high level, and voltages on the scan lines other than the scan line corresponding to the pth row of sub-pixels are at a low level in the (2i−1)th row period, wherein P is a positive integer;

in step S3, a voltage on the scan line corresponding to a p+1th row of sub-pixels is at the high level, and voltages on the scan lines other than the scan line corresponding to the p+1h row of sub-pixels are at the low level in the (2i)th row period.

* * * * *